United States Patent [19]

Besse

[11] 3,946,790

[45] Mar. 30, 1976

[54] GUIDANCE ARRANGEMENT FOR OPENING AND CLOSING PANELS ARTICULATED RELATIVE TO EACH OTHER AND RELATIVE TO A STATIONARY FRAME

[76] Inventor: Pierre Besse, Route de la Montzie Cap Blanc, Perigueux, Dordogne, France

[22] Filed: May 2, 1973

[21] Appl. No.: 356,335

[52] U.S. Cl. ..... 160/206; 160/199

[51] Int. Cl.[2] ..... E02D 15/26

[58] Field of Search ..... 160/206, 201, 133, 229, 160/183; 16/87 R, 105

[56] References Cited

UNITED STATES PATENTS

| | | | |
|---|---|---|---|
| 277,542 | 5/1883 | Bullard | 16/106 X |
| 370,109 | 9/1887 | Woldorf | 16/106 |
| 1,426,170 | 8/1922 | Frantz | 16/106 X |
| 1,499,312 | 6/1924 | Ferris | 160/199 |
| 1,503,364 | 7/1924 | Howat | 160/199 |
| 2,598,419 | 5/1952 | O'Hearn et al. | 160/206 X |
| 2,633,088 | 3/1953 | King | 16/106 X |
| 3,378,058 | 4/1968 | Matyas | 160/118 |

*Primary Examiner*—Dennis L. Taylor

*Attorney, Agent, or Firm*—Weiser, Stapler & Spivak

[57] ABSTRACT

The invention relates to a guidance arrangement for opening and closing panels which are articulated relative to each other and relative to a stationary frame. The arrangement is characterized by an articulated joint between a guide channel and the panel to be guided, this joint comprising a support plate holding two rollers, one guided by the inside of an omega-shaped channel, the other forming a rolling bearing for the panel.

7 Claims, 4 Drawing Figures

GUIDANCE ARRANGEMENT FOR OPENING AND CLOSING PANELS ARTICULATED RELATIVE TO EACH OTHER AND RELATIVE TO A STATIONARY FRAME

BACKGROUND OF THE INVENTION

This invention relates generally to an arrangement for guiding, during opening and closing, garage or closet door panels which are articulated relative to each other and relative to a stationary frame.

It is known to provide various types of doors for closets, garages and other enclosures. The awkwardness of rigid-panel doors has led to the development of more adaptable doors constituted of at least two panels, articulated relative to each other so as to be parallel to the plane of the door frame when closed, and perpendicular to that plane when open. Each door pane is formed of at least two such panels, joined to each other by a hinge and one of these panels being pivotally joined to one of the side joints of the door frame.

The panels of these doors are generally guided by pegs, which slide in channels formed in the head and the sill of the door frame. This type of door is difficult to build and adjust, and inconvenient to operate due to friction between the edges of the door panels and that channel on the one hand, and the friction of the guiding pegs within their channel on the other hand.

In his French Pat. No. 70-40839, granted Nov. 15, 1971, the applicant proposed to replace the pegs of the prior art by a roller which was rotatably mounted on a horizontal rod and run in a horizontal, laterally-opened, straight channel. The rod was connected to the outer panel of the closure assembly, that is, the panel remote from the hinging vertical frame member. This construction improved over the prior art in eliminating friction between the guiding pegs within the channels and between the edges of the door panels and that channel. One drawback found in this construction resided in that the joint was such that the guiding channel was positioned below the upper horizontal frame member and thus became visible when the closure assembly was open.

To obviate this new drawback, the applicant proposed an improvement in French patent of addition No. 71-01499 granted Aug. 7, 1972. According to this improvement, the joint of the main French Pat. No. 70-40839 was replaced by a crank with two vertical end shafts, one end shaft bearing a roller through a horizontal rod and the other end shaft being pivoted in a bracket to the outer door panel. This construction raised the roller and consequentially the laterally opened guiding channel. The guiding channel thus became at least partly invisible behind the upper horizontal frame member. This improvement presented another drawback in that the mechanical connection between the upper end shaft of the crank and the roller, through an ear and a rod, was too complicated.

In a second patent of addition No. 71-09561 granted Oct. 2, 1972, the applicant proposed a new improvement wherein the laterally opened guiding channel was replaced by a downwardly opened channel which accommodated a roller rotatably mounted directly on the upper end shaft of a crank. It was found in this construction that friction occurred between the guiding channel and the upper part of the vertical free edge of the outer panel of the closure assembly, this upper part being at an angle with the guiding channel for the main part of the movement of the closure assembly. As at the end of the closure movement, the outer panel of the closure assembly was linked to the frame only through the crank whose roller was free to slide in the channel, the vertical free edge of the outer panel could reach its final position, when outwardly offset in relation with the plane of the door. Thus the user had to push the outer panel inwardly to bring it back to this plane. If the closure assembly included two panel sets, this meant that the user had to push inwardly simultaneously the outer panels of both panel sets so as, for instance, to engage a tongue on the vertical free edge of one outer panel into a groove in the vertical free edge of the other outer panel. Additionally, the door assembly of French patent of addition No. 71-09561 must include locking means to keep each closure assembly in its closed position.

U.S. Pat. No. 3,066,730 shows a typical prior art guidance arrangement which differs from the present invention in that it does not show any second guiding roller which is adapted to engage the unobstructed vertical surface of the channel. Further, a rigid stop is employed rather than resilient so that the toggle (or over dead center) effect can not be achieved.

SUMMARY OF INVENTION

Accordingly, the object of the present invention is to overcome these difficulties by providing a guidance arrangement which is of simple construction, easy to install and adjust, and free of friction during opening and closing.

To this end there is provided, in accordance with the invention, a guidance arrangement for the opening and closing of panels which are articulated relative to each other and relative to a stationary frame comprising two vertical side members connected at the top by a horizontal head member to which latter there is attached a channel of inverted U-shaped crosssection. This arrangement is characterized by an articulated joint between the free vertical edge of one member of a pair of articulated panels and the omega-shaped channel, this joint comprising a support plate affixed to said panel and supporting two rollers. One of these is positioned inside the channel for guiding the panel. The other rests against the outer vertical face of the channel, parallel to the plane of displacement of the free edge of said panel, and forms a rolling bearing for the panel. It is the object of the present invention to obviate the drawbacks found in the prior art type of panel guidance arrangements. To this end, a support plate has been provided which rotatably carries the lower end part of a guide roller bearing crank. Additionally, the support plate carries a vertical shaft upon which is mounted a roller which is adapted to cooperate with the adjacent vertical surface of the channel. A resilient stop is placed within the channel to cooperate with the crank guide roller. A door equipped with a guidance arrangement according to the invention is illustrated in the accompanying drawings, wherein;

DESCRIPTION OF THE PREFERRED EMBODIMENTS OF THE INVENTION

Figure 1:
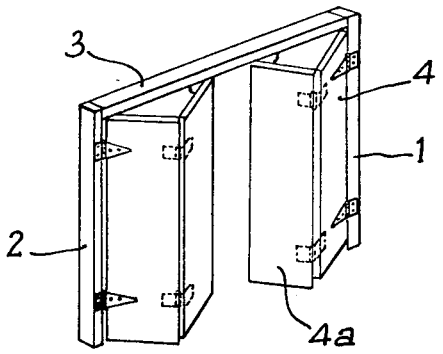
FIG. 1 is a perspective view of such a door with articulated panels.

In accordance with the invention, as shown in FIG. 1, the arrangement is particularly intended to provide guidance during opening and closing of panels articulated relative to each other and to a stationary frame. The stationary frame comprises two vertical members 1 and 2, connected at their upper ends by a transverse horizontal member 3. A panel 4 is pivotally attached to the vertical members 1 and 2, and itself pivotally joined to a second panel 4*a*. In this embodiment, a door pane composed of two panels can occupy two distinct positions, one perpendicular to the plane defined by the stationary frame, and the other parallel to that plane.

Figure 2:
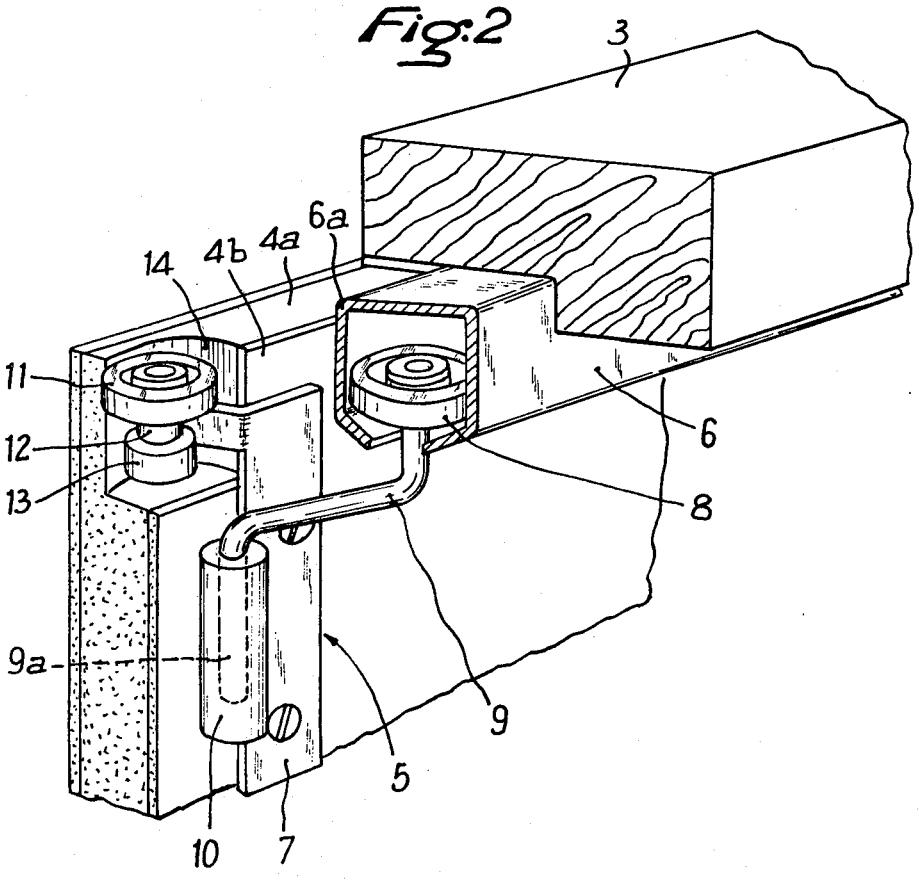
FIG. 2 is a perspective view showing partially in cross-section, the components of the guidance arrangement associated with the guided panel of a closure composed of at least two articulated panels.
Figure 3:
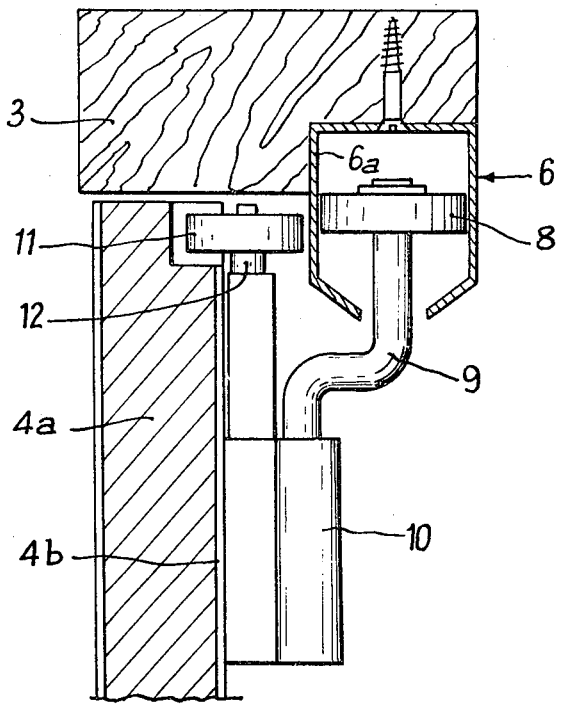
FIG. 3 is a cross-sectional view of the components shown in FIG. 2.
Figure 4:
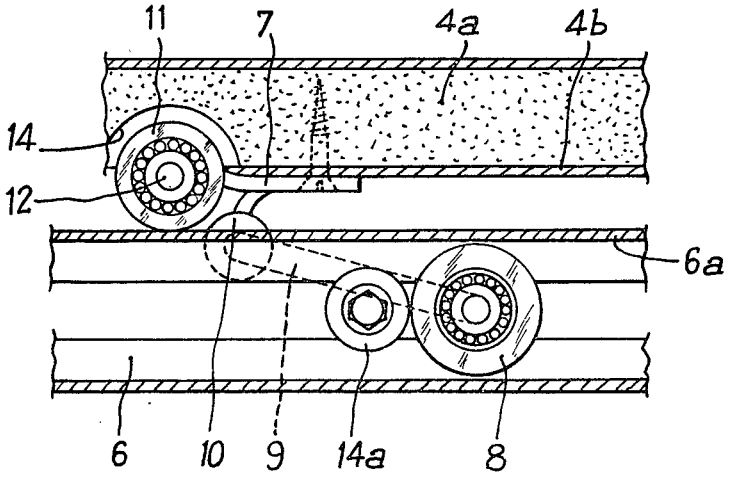
FIG. 4 is a plan view, partially in cross-section, of the components of the guidance arrangement.

The components of the guidance arrangement for opening and closing these panels appear in detail in FIGS. 2 to 4. The arrangement itself consists of an articulated joint designated by general reference 5. This joint is located between a guide channel 6 of inverted U-shaped cross-section and the inside free edge of panel 4*a*. Channel 6 is partially recessed in the transverse horizontal member 3 of the door frame, in such a manner that the outer vertical face 6*a* of channel 6 provides a track whose function will be described later.

Joint 5 consists of a support plate 7 attached near the upper inside edge of panel 4*a*. This plate supports two rollers, one 8 for guiding the panel 4*a*, the other 11 forming a rolling bearing for that panel. Guide roller 8 is positioned inside the inverted U-shaped channel 6. This roller is connected to plate 7 by a double-ended crank 9 pivotable relative to plate 7. In the embodiment shown, the pivot consists of a support sleeve 10, which receives the lower vertical extremity 9*a* of crank 9. Crank 9 can therefore pivot by at least one hundred and eighty degrees during opening and closing of panels 4 and 4*a*. Roller 11, which forms the rolling bearing, is connected to plate 7 by a shaft 12, attached to the end of an arm 13, which arm is formed of one piece with plate 7. Arm 13 has a bent end, which follows the contour of a notch 14, which is carved out of the width of panel 4*a* in such a manner that roller 11 is recessed partially within the notch, thereby reducing the spacing between the plane defined by the inside face of panel 4*a* and the track provided by the vertical face 6*a* of guide channel 6. The advantage of this construction is most apparent from FIGS. 3 and 4 which show that face 4*b* of panel 4*a* is kept out of direct contact with side 6*a* of the channel by means of support roller 11. This assures free movement of the door pane during opening and closing, since it eliminates the friction which constituted a serious drawback of prior arrangements. By combining guide roller 8 and roller 11, which forms a rolling bearing, silent opening and closing is assured, with ease and without jamming. A stop 14*a* is provided for guide channel 6 against which guide roller 8 bumps at the end of its travel. Stop 14*a* is preferably made of elastic material, partly to provide silent contact and partly to provide a certain amount of elasticity which contributes to immobilization of the door when it is closed.

It will be understood that the invention is not limited to the embodiment described and shown above. Other modes and forms of embodiment could be used if desired without departing from the inventive concept.

I claim:

1. In a door assembly of the type comprising a stationary frame including two vertical members connected at their upper ends by a transverse horizontal member, the horizontal member being interiorly defined by a vertical face, a closure assembly including a set of two rigid panels, to wit an inner panel and an outer panel, said panels having interior faces, said inner panel being pivoted to one of said vertical members by a first hinge means and said outer panel being pivoted to the inner panel by a second hinge means so that the panels are parallel to the plane of the frame when closed and perpendicular to that plane when open, and a guidance arrangement including an integral crank and a downwardly opened, inverted U-shaped channel secured laterally to said transverse horizontal member exteriorly from the vertical face to define a space between the channel and the said vertical face and provided with a substantially unobstructed vertical surface facing the closure assembly, said crank being formed with an horizontal intermediate portion and with two vertical end portions, to wit an upper end portion and a lower end-portion, the lower end-portion being pivoted in a support plate secured to the outer panel adjacent the top of its vertical edge remote from the second hinge means and the upper end-portion extending into said channel and rotatably mounting a first guiding roller within said channel;

the improvement which comprises the support plate independently rotatably carrying a second guiding roller, said roller adapted to engage said vertical surface of the channel, said second roller being positioned within the space defined between the channel and the vertical face, and means to position the interior faces of the panels in substantially co-planar relationship with the vertical face.

2. Door assembly of claim 1, wherein the support plate is formed with a sleeve for pivoting the lower vertical end-portion of said crank and wherein the means to position includes a notch formed in the outer door panel rearwardly of the interior face, at least a portion of the second guiding roller being positioned within the notch.

3. A guidance arrangement for opening and closing panels having interior faces, said panels being articulated relative to each other and relative to a stationary frame comprising two vertical members joined by an upper transverse horizontal member which is interiorly defined by a vertical face, and to which a track having an outside vertical surface is attached rearwardly of said vertical face, said track defining an inverted U-shaped channel, at least one of said panels having a free vertical edge, the combination of A. an articulated joint between the free vertical edge and the track, 1. the free edge being provided with a recessed notch,
2. said joint including a support plate attached to said free vertical edge, a crank, and two rollers, one roller being carried by the crank,
   a. one said roller being positioned inside the channel for guiding the one said panel,
   b. the second roller being rotatably carried by the support plate and being positioned at least partially within the notch, c. the second roller rolling against the outside vertical surface of the track, d. the second roller forming a rolling bearing for the said panel parallel to the plane of movement of the vertical free edge of the panel, e. said second roller, said vertical surface of the track and said notch cooperating to position the interior faces of the panels in substantially co-planar arrangement with the vertical face of the frame member.

4. A guidance arrangement according to claim 3 wherein the second roller is rotatably connected to the plate, said second roller connection being independent of the one said roller.

5. The invention of claim 3 wherein the one said roller is pivotally connected to the support plate by a the crank and wherein the one said roller can pivot relative to the support plate independently of the second roller.

6. The guidance arrangement of claim 3 wherein a portion of the second roller extends exteriorly of the notch towards the track, the said portion spacing the panel from the outside vertical surface of the track, the said spacing being a sufficient distance to prevent frictional engagement of the panel and the track.

7. A guidance arrangement in a door assembly comprising a stationary frame including two vertical members connected at their upper ends by a transverse horizontal member; a closure assembly including a set of two rigid panels, to wit an inner panel and an outer panel, said inner panel being pivoted to one of said vertical members by a first hinge means and said outer panel being pivoted to the inner panel by a second hinge means parallel to the first hinge means so that the panels are parallel to the plane of the frame when closed and perpendicular to that plane when open, and a guidance arrangement including an integral crank and a downwardly opened, inverted U-shaped channel secured laterally to said transverse horizontal member and provided with a substantially unobstructed vertical surface facing the closure assembly, said crank being formed with an horizontal intermediate portion and with two vertical end-portions to wit an upper and a lower end-portion, the lower end-portion being pivoted in a support plate secured to the outer panel adjacent the top of its vertical edge remote from the second hinge means and the upper end-portion extending into said channel and forming a first vertical shaft rotatably mounting a first guiding roller within said channel;

the improvement consisting in that the support plate rotatably carries on a second vertical shaft separate from said first shaft a second guiding roller adapted to engage said vertical surface of the channel, which channel carries a resilient stop adapted to be abutted against by the first guiding roller near the end of the closing movement of the closure assembly.

* * * * *